United States Patent [19]

Zafred et al.

[11] Patent Number: 4,672,741

[45] Date of Patent: Jun. 16, 1987

[54] END EFFECTOR APPARATUS FOR POSITIONING A STEAM GENERATOR HEAT EXCHANGER TUBE PLUGGING TOOL

[75] Inventors: Paolo R. Zafred, Pittsburgh; Luciano Veronesi, O'Hara Township, Allegheny; Robert J. Maurer, Monroeville, all of Pa.

[73] Assignee: Westinghouse Electric Corp., Pittsburgh, Pa.

[21] Appl. No.: 749,603

[22] Filed: Jun. 27, 1985

[51] Int. Cl.[4] ..... B23P 15/26; B23P 19/00

[52] U.S. Cl. ..... 29/726; 29/400 N; 29/522 R; 29/714; 29/723; 29/809; 29/818; 33/286; 165/76; 376/249; 376/463; 414/145; 901/41; 901/45

[58] Field of Search ..... 29/400 N, 522 R, 523, 29/703, 714, 723, 726, 809, 818; 33/286; 165/71, 76; 376/249, 250, 251, 463; 414/145; 901/2, 41, 45

[56] References Cited

U.S. PATENT DOCUMENTS

| | | | |
|---|---|---|---|
| 3,691,609 | 9/1972 | Ice, Jr. et al. | 165/71 X |
| 4,205,939 | 1/1978 | Reyes | 165/76 X |
| 4,231,690 | 11/1980 | Burns | 408/80 |
| 4,303,368 | 12/1981 | Dent et al. | 165/76 X |
| 4,329,769 | 5/1982 | Glatthorn | 29/726 X |
| 4,369,662 | 1/1983 | Rieben et al. | 29/552 R X |
| 4,390,042 | 1/1983 | Kucherer et al. | 29/523 X |
| 4,393,899 | 7/1983 | Tsuji et al. | 165/76 X |

OTHER PUBLICATIONS

Jack Rebman, "Compliance For Robotic Assembly Using Elastomeric Technology", Lord Corp. (U.S.A.), a paper presented at the Ninth International Symposium on Industrial Robots, Washington, D.C. (March 1979), pp. 153–166.

*Primary Examiner*—Howard N. Goldberg
*Assistant Examiner*—Ronald S. Wallace

[57] ABSTRACT

An apparatus for moving and positioning a tool for plugging a defective heat exchanger tube of a steam generator in a nuclear reactor includes a base, a plug magazine supported on the base, a guidance mechanism mounting the plugging tool and a positioning mechanism supported on the base and mounting the guidance mechanism. The guidance mechanism is operable to align and position the tool relative to the plug magazine and the defective heat exchanger tube to correspondingly effect, upon operation of the tool, plug loading when the tool is located in a plug dispensing position adjacent to the plug magazine and plug unloading when the tool is located in a plug applying position adjacent to the defective tube. The positioning mechanism is operable to assume folded and unfolded conditions to transfer the guidance mechanism and the plugging tool therewith respectively between the plug dispensing and applying positions. The guidance mechanism employs a remote center compliance device in the form of a plurality of laminated elastomer and metal shim elements which extend between and connect the plugging tool and a guide fixture of the guidance mechanism. Also, the compliance device is operable to correct lateral and angular misalignments of the tool with the plug magazine and the defective tube as the guidance mechanism is moved toward same when disposed at the respective plug dispensing and applying positions. Further, the positioning mechanism employs an articulated linkage which is moved in sissor-like fashion between the folded and unfolded conditions for respectively moving the guidance mechanism and plugging tool therewith between the plug dispensing and applying positions.

29 Claims, 9 Drawing Figures

END EFFECTOR APPARATUS FOR POSITIONING A STEAM GENERATOR HEAT EXCHANGER TUBE PLUGGING TOOL

BACKGROUND OF THE INVENTION

1. Field of the Invention

The present invention relates generally to maintenance of steam generators of nuclear reactor power plants and, more particularly, is concerned with an end effector apparatus for moving and positioning a tool for plugging a defective heat exchanger tube of the steam generator.

2. Description of the Prior Art

There are many situations in which a hazardous environment limits human access to various locations. One such situation occurs in the maintenance of operating steam generators of nuclear reactor power plants. A typical steam generator in a pressurized water nuclear reactor (PWR) includes a vertically oriented shell, a plurality of U-shaped tubes disposed in the shell so as to form a tube bundle, a tube sheet for supporting the ends of the tube bundle opposite its U-like curvature, and a dividing plate that cooperates with the tube sheet to form a primary fluid inlet plenum at one end of the tube bundle and a primary fluid outlet plenum at the other end of the tube bundle.

The steam generators of the PWR receive both primary and secondary fluids to produce steam for subsequent production of electricity in a conventional manner. The primary fluid, after being heated by circulation through the nuclear reactor core, enters the steam generator through the primary fluid inlet plenum. From its inlet plenum, the primary fluid flows upwardly through the one end of the tube bundle supported by the tube sheet, through its U-like curvature, downwardly through its opposite other end also supported by the tube sheet, and into its outlet plenum. At the same time, a secondary fluid, known as feedwater, is circulated around the U-shaped tube bundle in heat transfer relationship therewith, thereby transferring heat from the primary fluid in the tubes of the bundle to the secondary fluid surrounding the tube bundle and causing a portion of the secondary fluid to be converted to steam. Since the primary fluid contains radioactive particles and is isolated from the secondary fluid by the U-shaped walls of the tubes and by the tube sheet, it is important that the tubes and the tube sheet be maintained defect-free so that no leaks will occur in the tubes or in the welds between the tubes and the tube sheet thus preventing contamination of the secondary fluid by the primary fluid.

Occasionally it is necessary to either inspect or repair the tubes of the bundle or tube sheet welds by way of access through the primary fluid inlet and outlet plena. For this purpose manways are provided in the vertical shell so that working personnel may enter the inlet and outlet plena to perform operations on the tubes and tube sheet. However, since the primary fluid, which is generally water, contains radioactive corrosion products, the inlet and outlet plena become radioactive which thereby limits the time that working personnel may be present therein. Accordingly, it would be advantageous to be able to perform operation on the tubes and tube sheet without requiring the entry of working personnel.

There are several mechanisms known in the art that attempt to provide a solution to this problem. Some of such mechanisms are described in U.S. patents to Dent et al (U.S. Pat. No. 4,303,368), Rieben et al (U.S. Pat. No. 4,369,662) and Kucherer et al (U.S. Pat. No. 4,390,042), which are as to the assignee of the present invention, and in patents and applications memtioned in these patents. While these mechanisms appear to operate satisfactorily under the limited range of conditions for which they were designed, a need still exists for an improved mechanism which reduces personnel radiation exposure, shortens plug installation time, offers greater versatility and speed, and requires less skill and training for the operators of the equipment.

SUMMARY OF THE INVENTION

The present invention provides an end effector apparat for positioning a plugging tool which is designed to satisfy the aforementioned needs. The effector apparatus can be set up and removed from the steam generator without requiring personnel entry into the highly radioactive area of the generator. It can rapidly and accurately position the plugging tool for insertion and expansion of the plug on the tool mandrel into the leaking heat exchanger tube. The apparatus includes a remote center compliance device which can compensate for misalignments, inaccuracies and variations in the tube sheet hole pattern for efficient application of a plug to any tube desired. Also, a plug magazine is included in the apparatus which allows fast reloading of the tool mandrel. In summary, the effector apparatus of the present invention reduces set up and installation time, improves operational reliability, demands less technical training and skill of personnel and reduces exposure of personnel to radiation.

Accordingly, the present invention is broadly directed to an apparatus for moving and positioning a tool for performing operations on a workpiece, wherein the apparatus comprises: (a) a base; (b) a guidance mechanism mounting the tool and being operable to align and position the tool for effecting operation of the tool on a workpiece and loading of the tool after each operation thereof; and (c) a positioning mechanism supported on the base and mounting the guidance mechanism, the positioning mechanism being operable to transfer the guidance mechanism and the tool therewith between respective tool operating and loading positions. Additionally, a magazine is supported on the base for supplying the tool when the tool is transferred with the guidance mechanism to the loading position by the positioning mechanism.

More particularly, the apparatus is useful for moving and positioning a tool for plugging a defective heat exchanger tube of a steam generator in a nuclear reactor. The apparatus for moving and positioning the plugging tool comprises: (a) a plug magazine; (b) a guidance mechanism mounting the plugging tool and being operable to align and position the tool relative to the plug magazine and the defective heat exchanger tube to correspondingly effect, upon operation of the tool, plug loading when the tool is located in a plug dispensing position adjacent to the plug magazine and plug unloading when the tool is located in a plug applying position adjacent to the defective tube; (c) a positioning mechanism mounting the guidance mechanism, the positioning mechanism being operable to transfer the guidance mechanism and the plugging tool therewith between the plug dispensing and applying positions; and (d) a base supporting the plug magazine and the positioning mechanism.

Still further, the positioning mechanism includes an articulated linkage being pivotally coupled to the base by a first pair of pivotal connections and pivotally coupled to the guidance mechanism by a second pair of pivotal connections, and power means coupled to the articulated linkage for actuating the linkage between folded and unfolded conditions for respectively moving the guidance mechanism and plugging tool therewith between the plug dispensing and applying positions. Additionally, the guidance mechanism includes a guide fixture and a remote center compliance device. The guide fixture is mounted on the articulated linkage of the positioning mechanism for movement toward and away from the plug magazine and the defective heat exchanger tube when the guidance mechanism and the plugging tool are disposed respectively at the plug dispensing and applying positions. The remote center compliance device extends between the plugging tool and the guide fixture so as to interconnect the tool to the guide fixture and is operable to correct lateral and angular misalignments of the tool with the plug magazine and the defective tube as the guide fixture is moved toward the same when the guidance mechanism is disposed at the respective plug dispensing and applying positions. The guidance mechanism also includes drive means for moving the guide fixture toward and away from the plug magazine and the defective tube when the guidance mechanism is disposed at the respective plug dispensing and applying positions.

In its preferred form, the compliance device of the guidance mechanism includes a plurality of laminated elastomer and metal shim elements which together define a center of compliance and are oriented with respect to a central axis of the plugging tool so as to project their center of compliance to a point on the central axis of the plugging tool located at a leading end of the tool. Also, each of the compliance elements exhibits high lateral flexibility and high axial inflexibility or stiffness such that together they are capable of correcting lateral and angular misalignments of the tool with the plug magazine and the defective tube as the guide fixture is moved toward the same when the guidance mechanism is disposed at the respective plug dispensing and applying positions.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
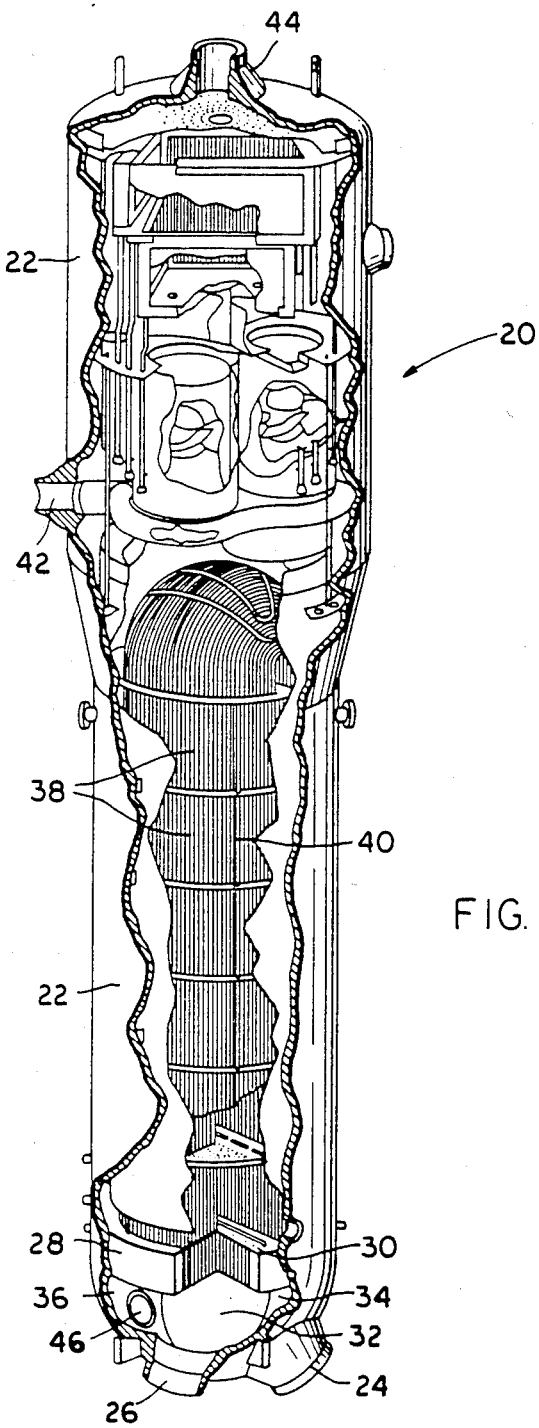
FIG. 1 is an elevational view, partly in section and partly broken away, of a typical steam generator of a nuclear reactor power plant in which the end effector apparatus of the present invention can be used for maneuvering a plugging tool to perform maintenance operations on a defective heat exchanger tube of the steam generator.

In the following description, like reference characters designate like or corresponding parts throughout the several views. Also in the following description, it is to be understood that such terms as "forward", "rearward", "left", "right", "upwardly", "downwardly" and the like, are words of convenience and are not to be construed as limiting terms.

IN GENERAL

Steam Generator

Referring now to the drawings, and particularly to FIG. 1, there is shown a steam generator, generally designated 20, of a nuclear reactor power plant, such as a pressurized water reactor (PWR). The steam generator 20 includes an outer shell 22 with a primary fluid inlet nozzle 24 and a primary fluid outlet nozzle 26 attached thereto near its lower end. A generally cylindrical tube sheet 28 having tube holes 30 therein is also attached to the outer shell 22 near its lower end. A dividing plate 32 attached to both the tube sheet 28 and outer shell 22 defines a primary fluid inlet plenum 34 and a primary fluid outlet plenum 36 in a lower end of the steam generator as is well understood in the art.

The steam generator 20 further includes a plurality of tubes 38 which are heat transfer tubes shaped with a U-like curvature. The tubes 38 are disposed within the outer shell 22 and attached to the tube sheet 28 by means of the tube holes 30 therein. The tubes 38 which may number about 7000 form a tube bundle 40. In addition, the steam generator 20 has a secondary fluid inlet nozzle 42 disposed on its outer shell 22 for providing a flow of secondary fluids such as water into the shell and around the tube bundle 40. Also, a steam outlet nozzle 44 is attached to the top of the outer shell 22.

In operation, the primary fluid which may be water having been heated by circulation through the nuclear reactor core enters the steam generator 20 through the primary fluid inlet nozzle 24 and flows into the primary fluid inlet plenum 34. From the primary fluid inlet plenum 34, the primary fluid flows upwardly through the tubes 38 at the tube sheet 28, and therefrom up through the U-shaped curvature of the tubes 38, then down through tubes 38 and into the primary fluid outlet plenum 36 where the primary fluid exits the steam generator 20 through the primary fluid outlet nozzle 26. While the primary fluid is flowing through the tubes 38, heat is transferred from the primary fluid to the secondary fluid which surrounds the tubes 38 causing the secondary fluid to vaporize. The resulting steam then exits the steam generator 20 through the steam outlet nozzle 44.

Remotely-Operated Maintenance Equipment

On occasion, it is necessary to inspect or repair tubes 38 or the welds between the tubes 38 and the tube sheet 28 to assure that the primary fluid which may contain radioactive particles remains isolated from the secondary fluid. Therefore, manways 46 are provided in the outer shell 22 to provide access to both the primary fluid inlet plenum 34 and outlet plenum 36 so that access may be had to the entire tube sheet 28.

Figure 2:
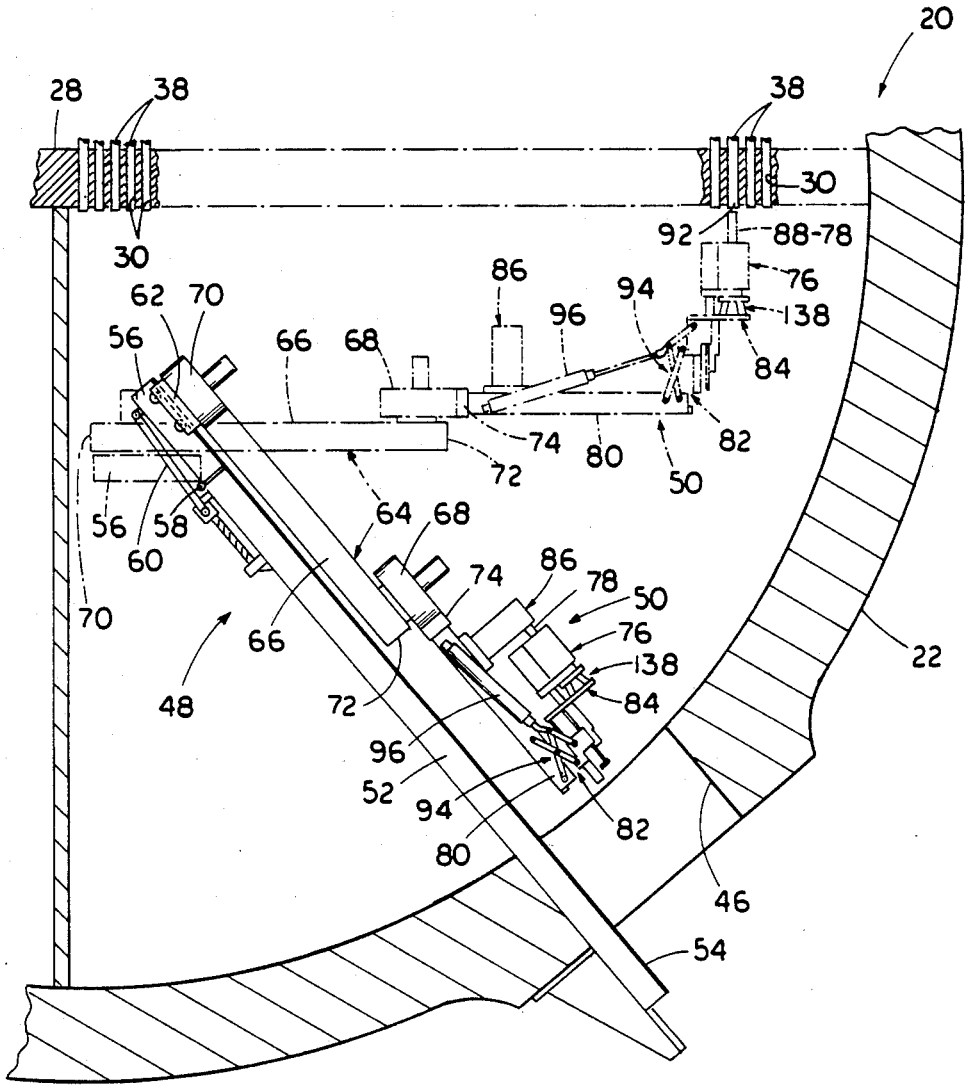
FIG. 2 is an enlarged view of a lower portion of the steam generator of FIG. 1, showing the remotely-operated equipment for performing the mechanical plugging operation which incorporates the end effector apparatus of the present invention.

As seen in FIG. 2, remotely-operated equipment, generally indicated by the numeral 48, which includes the end effector apparatus of the present invention, being designated 50 and to be described below, is mounted to the outer shell 22 of the steam generator 20 so as to extend through the manway 46 and into the respective one of the primary fluid plena 34,36. The equipment 48 includes a pole or track 52 in the form of an I-beam having a lower terminal end 54 located outside of the manway 46 and an opposite upper terminal end 56 located within the one of the primary fluid plena 34,36. The upper terminal end 56 of the track 52 takes the form of an extension which is pivotally mounted about a transverse axis 58 to the remainder of the track. An extendible and retractible means 60, such as a pneumatic cylinder, interconnects the track extension 56 and the remainder of the track 52 and is operable to pivot the extension between the solid and dashed line positions seen in FIG. 2.

The remotely-operated maintenance equipment 48 also includes a carriage 62 movable in a linear path along the track 52 and a manipulator arm 64 rotatably supported on the carriage. Once the carriage 62 has been moved inwardly so as to overlie the upper pivotal extension 56 of the track 52 and is retained there by suitable engaging means (not shown), the cylinder 60 can be actuated to pivot the track extension 56 and carriage 62 therewith to a generally horizontal disposition, as seen in dashed line form in FIG. 2. The manipulator arm 64 which supports the end effector apparatus 50 can then be operated to position the apparatus at any desired location with respect to the tube sheet 28 to perform maintenance operations on the tube sheet 28 and bundle 40.

More particularly, the manipulator arm 64 is composed of lower and upper arm segments 66,68. The lower arm segment 66 is pivotally mounted at one end 70 upon the carriage 62 for swinging about the carriage 62 along an arcuate path within a generally horizontal plane above the track extension 56 and carriage 62. The upper arm segment 68 is pivotally mounted to the opposite end 72 of the lower arm segment 66 and has an end socket 74 to which is attached the end effector apparatus 50 of the present invention. Thus, the respective arm segments 66,68 can swivel about respective vertical axes relative to one another and to the carriage 62 to movably position the end effector apparatus 50.

Suitable drive means and controls (not shown) are connected to the carriage 62 and manipulator arm 64 for remotely operating them from outside the steam generator 20. Thus, it is readily apparent that the manipulator arm 64 can be moved to position the end effector apparatus 50 adjacent to any selected portion of the tube sheet 28 of the steam generator 20 where maintenance operations need to be carried out. Since the carriage 62 and manipulator arm 64 of the maintenance equipment 48 form no part of the present invention and a detailed knowledge of the structure and operation thereof is not necessary for understanding the end effector apparatus 50, no further description of the carriage and manipulator arm will be presented herein. A fixture commercially available from Zetec of Issaquah, Washington under the tradename SM-10 can be used to provide the functions of the carriage and manipulator arm.

END EFFECTOR APPARATUS

Overall Apparatus

Turning now to FIGS. 2 to 5, there is seen the preferred embodiment of the end effector apparatus 50 of the present invention. The primary objective of the effector apparatus 50 when used in the environment of the nuclear reactor steam generator 20 is to move and position a tool 76 for plugging a defective, such as a leaking, one of the plurality of heat exchanger tubes 38 of the bundle 40 thereof located in the steam generator. The plugging tool 76 can be the one disclosed in U.S. Pat. No. 4,369,662 to Rieben et al and assigned to the assignee of the present invention, although it is possible to use some other plugging tool. Also, the plug 78 which is applied by the plugging, tool 76 can be the one disclosed in U.S. Pat. No. 4,390,042 to Kucherer et al, although it is likewise to use some other plug, such as the one disclosed in U.S. Pat. No. 4,502,511 to Zafred which too is assigned to the assignee of the present invention.

Although the end effector apparatus 50 is disclosed herein in application to the plugging of defective tubes, it has general application to the machine tool art. Basically, the effector apparatus 50 can be incorporated in any machine or apparatus where it is desired to displace a tool with respect to a workpiece in a mode comparable to that in which the plugging tool 76 is maneuvered by the effector apparatus, as will be described in detail shortly.

Figure 3:
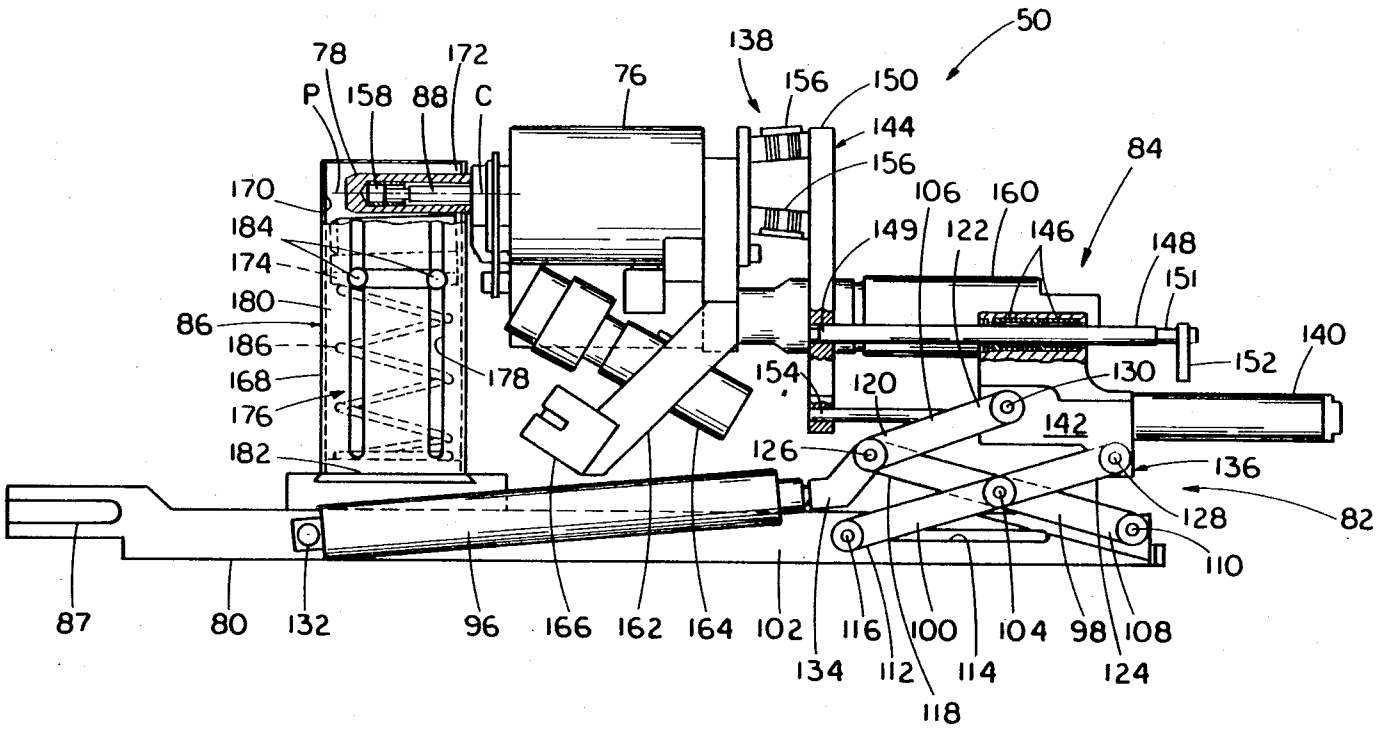
FIG. 3 is a side elevational view of the end effector apparatus of the present invention disconnected from the remainder of the remotely-operated equipment of FIG. 2, showing a positioning mechanism of the effector apparatus in a folded condition for locating the plugging tool supported thereon adjacent to a plug magazine also supported by the effector apparatus in order to effect loading of a plug on a mandrel of the tool.
Figure 4:
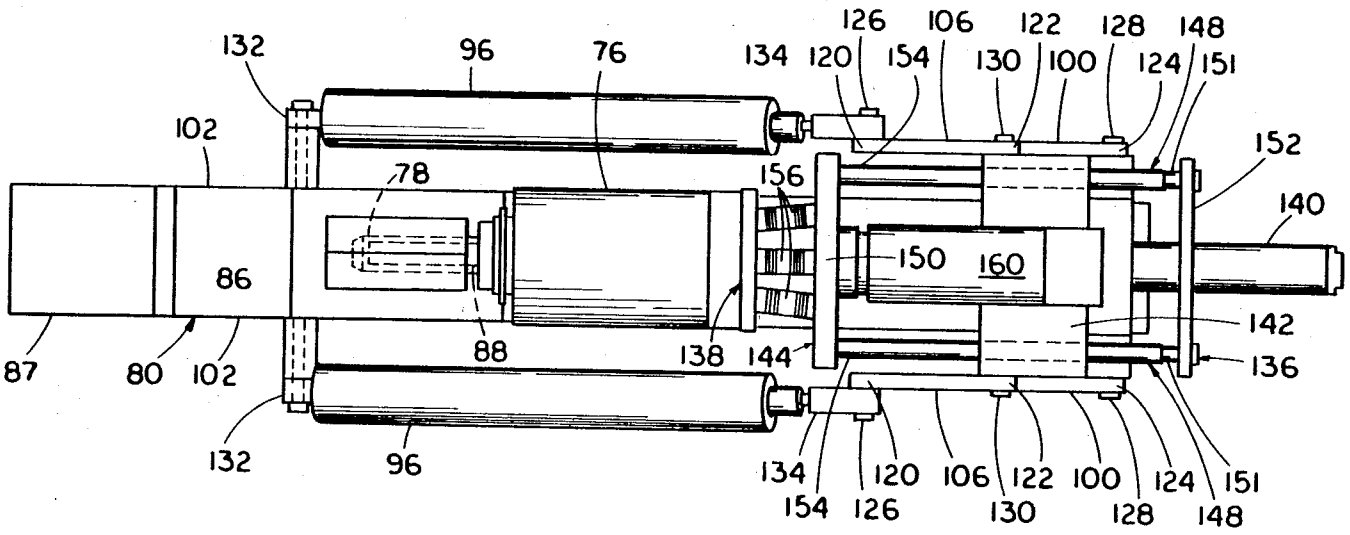
FIG. 4 is a top plan view of the apparatus of FIG. 3.
Figure 5:
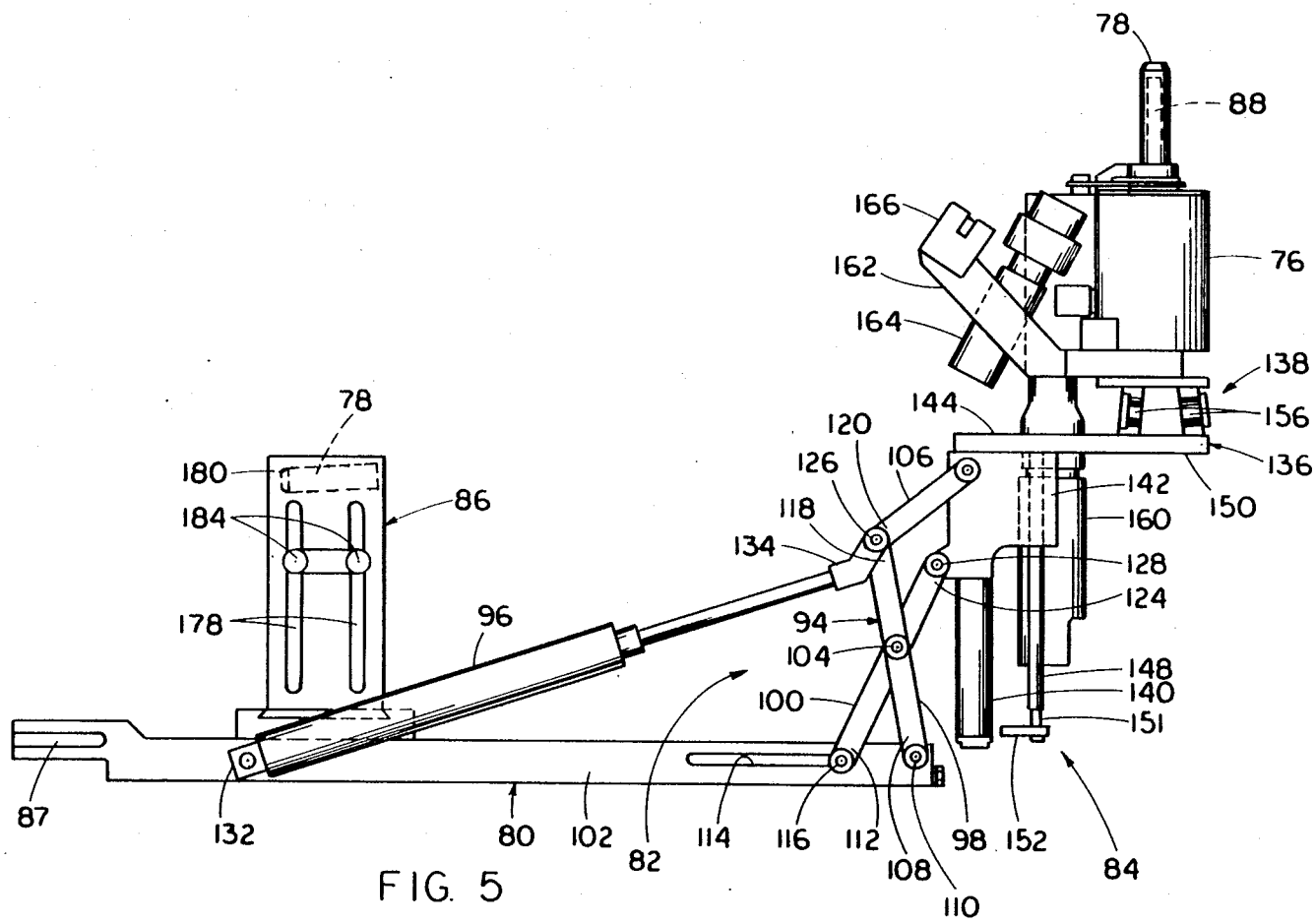
FIG. 5 is another side elevational view of the end effector apparatus similar to that of FIG. 3, but showing the positioning mechanism of the effector apparatus in an unfolded condition for locating the plugging tool adjacent to a defective heat exchanger tube to effect plugging of the tube.

As seen in FIG. 2 and in more detail in FIGS. 3 to 5, the end effector apparatus 50 basically includes a base 80, a positioning mechanism 82, a guidance mechanism 84 and a plug magazine 86. The positioning mechanism 82 and the plug magazine 86 are supported on the base 80 along opposite end portions thereof. The base 80 has a quick-connect socket 87 at one end for attachment of the apparatus 50 to the end socket 74 of the manipulator arm 64. The positioning mechanism 82 mounts the guidance mechasism 84 which, in turn, supports the plugging tool 76. The guidance mechanism 84 disposes the plugging tool 76 between it and the plug magazine 86 such that a mandrel 88 of the tool which receives a plug 78 from the magazine 86 faces an upper dispensing end 90 of the magazine when the positioning mechanism 82 is in a folded condition as seen in FIGS. 3 and 4. Also, as can be discerned from FIG. 2, the positioning mechanism 82 must be in its folded condition for placing the end effector apparatus 50 at its minimum height in order to allow insertion thereof through the manway 46. Once within the desired one of the primary fluid plena 34,36, the positioning mechanism 82 can be actuated to an unfolded condition, as seen in FIG. 5 and in dashed line form in FIG. 2, in which the end effector apparatus 50 is now at its maximum height.

In an overall sense, the positioning mechanism 82 in moving between its folded and unfolded conditions is operable to transfer the guidance mechanism 84 and the plugging tool 76 therewith between plug dispensing and plug applying positions located respectively adjacent to the plug magazine 86, as shown in solid line form in FIG. 2, and an open end 92 of a tube 38, as seen in dashed line form in FIG. 2. At the plug dispensing and applying positions, the guidance mechanism 84 is then operable to align and position the plugging tool 76 relative to the plug magazine dispensing end 90 and the open end 92 of the tube 38 respectively to correspondingly effect plug loading onto and unloading from the tool mandrel 88 via operation of the plugging tool 76 in a known manner.

Positioning Mechanism

As depicted in FIGS. 3 to 5, the positioning mechan 82 includes an articulated linkage, generally designated 94, being pivotally coupled to and extending between the base 80 and the guidance mechanism 84, and power means in the form of a pair of extendible and retractible pneumatic cylinders 96 being coupled to and extending between the base 80 and the articulated linkage 94 for actuating the linkage between the folded and unfolded conditions and thereby respectively moving the plugging tool 76 between the plug dispensing and applying positions, identified above with respect to FIG. 2.

The articulated linkage 94 includes a pair of elongated links 98,100 disposed along each lateral side 102 of the base and pivotally interconnected to one another at pivot points 104 in scissor-like fashion, as well as a third elongated link 106 also disposed along each lateral base side 102. In each pair of links 98,100, the one link 98 is pivotally coupled at its lower end 108 to the base 80 so as to form a pivotal connection 110 which is stationary with respect to the base 80. In contrast thereto, the other link 100 is pivotally coupled at its lower end 112 to an elongated slot 114 defined in the base 80 so as to form a pivotal connection 116 which is movable with respect to the base away from and toward the stationary pivotal connection 110 of the one link 98 to the base.

Also, the one link 98 is pivotally coupled at its upper end 118 to a lower end 120 of the third link 106, with the third link 106 in turn being pivotally coupled at its upper end 122 to the guidance mechanism 84. Lastly, the other link 100 is pivotally coupled at its upper end 124 to the guidance mechanism 84. Then, upon movement of the articulated linkage 94 between its folded and unfolded conditions, pivotal connections 126,128,130 between the upper ends 118,124 of the links 98,100, the guidance mechanism 84 and the opposite ends 120,122 of the third link 106 move angularly, some connections being displaced more and others less, with respect to the base as the guidance mechanism 84 is rotated between its angularly displaced plug dispensing and plug applying positions. For instance, the pivotal connection 130 of the third link upper end 122 to the guidance mechanism 84 revolves relative to the pivotal connection 128 of the other link upper end 124 to the guidance mechanism and is thus displaced through a greater distance for rotating the guidance mechanism 84 between generally horizontal and vertical dispositions.

Finally, each of the extendible and retractible cylinders 96 for actuating the articulated linkage 94 in its scissor-like fashion is disposed along one of the lateral side 102 of the base 80. Each cylinder 96 is pivotally anchored at one end 132 to the base 80 and pivotally coupled at an opposite end 134 jointly to both the upper end 118 of the one link 98 and the lower end 120 of the third link 106.

Guidance Mechanism

Referring now to FIGS. 3 to 7, there is seen the guidance mechanism 84 of the end effector apparatus 50 which basically includes a guide fixture 136, a remote center compliance device 138 and drive means 140. The guide fixture 136 is mounted on the positioning mechanism 82 for movement toward and away from the plug magazine 86 and the defective heat exchanger tube 38 when the guidance mechanism 84 and the plugging tool 76 are disposed respectively at the plug dispensing and applying positions, being identified earlier in FIG. 2. In particular, the guide fixture 136 includes a guide block 142 mounted on the upper ends 122,124 of the links 106,100 of the articulated linkage 94 of the positioning mechanism 82 and a support structure 144 supported by and movable relative to the guide block 142. The support structure 144 is movable along a generally translatory path toward and away from the plug magazine 86 and the defective tube 38 when the guidance mechanism 84 is disposed at the respective plug dispensing and applying positions. Specifically, the guide block 142 is provided with double bearings 146 which support and linearly guide a pair of spaced cylindrical shafts 148 attached at their leading ends 149 to a transversely oriented plate 150, the shafts 148 and plate 150 composing the support structure 144. The trailing ends 151 of the shafts 148 are mutually coupled with a bracket 152 to increase the stability of the guidance mechanism 84.

The support structure 144 is connected to the compliance device 138 and is actuated for movement along the translatory path by the drive means 140. The drive means 140 is in the form of an pneumatic cylinder affixed to the guide block 142 with its extendible and retractible rod end 154 attached to the support structure plate 150.

The remote center compliance device 138 extends between the rear side of the plugging tool 76 and the support structure plate 150 of the guide fixture 136 so as to interconnect the tool 76 to the part of the guidance mechanism 84 which is movable relative to the positioning mechanism 82. Overall, the compliance device 138 is operable to correct both lateral and angular misalignments of the plugging tool 76 with respect to the plug magazine 86 and the defective tube 38 as the plate 150 of the guide fixture 136 is moved toward the same when the guidance mechanism 84 is disposed at the respective plug dispensing and applying positions, depicted in FIG. 2.

More particularly, the remote center compliance device 138 of the guidance mechanism 84 takes the form of a plurality of laminated elastomer and metal shim elements 154, preferably three of the elements. The elements 154 have two characteristics which make the compliance device 138 effective. They are: (a) controlled flexibility (stiffness) and (b) controlled elastic center projection. Controlled flexibility is accomplished by the laminated arrangement of the elastomer and metal shims composing the elements 156. In compression, these elements 156 are much stiffer than in shear. A high ratio of compression to shear spring rate facilitates elastic center projection as well as controlled flexibility. For the particular application of the elements 156 herein a ratio of 100:1 was selected. However, by changing the particular elements, the performance of the compliance device 138 can be altered to meet specific application needs. The compliance elements 156 are also operable to transmit high plug insertion forces, and at the same time withstand high reaction moments generated by the tool mandrel 88 during expanding or decoupling of the plug 78.

Figure 7:
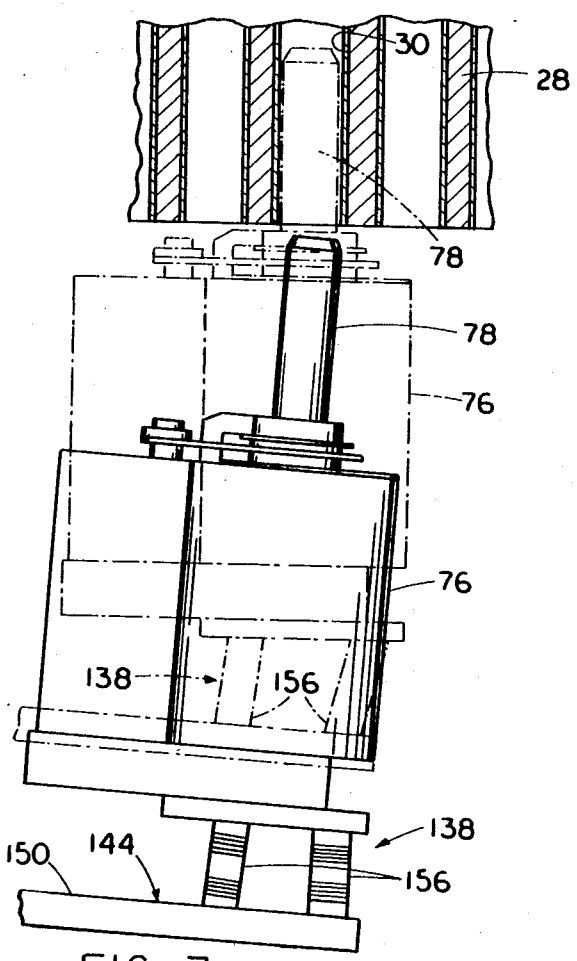
FIG. 7 is another schematical view of the guidance mechanism similar to that of FIG. 6, but showing the plugging tool in solid line form angularly misaligned with the tube sheet hole and in dashed line form after alignment with and insertion within the hole due to coaction of the compliance elements of the guidance mechanism.
Figure 6:
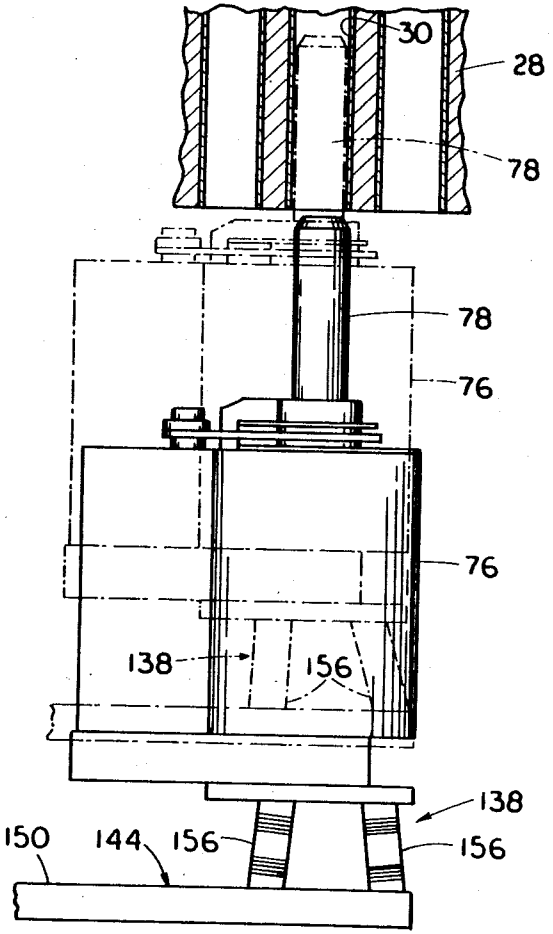
FIG. 6 is a schematical view of a guidance mechanism of the effector apparatus of FIG. 3 which supports the plugging tool on the positioning mechanism of the apparatus, the plugging tool being shown in solid line form laterally misaligned with a tube sheet hole and in dashed line form after alignment with and insertion within the hole due to coaction of the compliance elements of the guidance mechanism.

Suffice it to say that in the context of the end effector apparatus 50, the elements 156 exhibit high lateral flexibility and high axial stiffness. In so doing, they coact to correct both lateral and angular misalignments of the leading end 158 of the mandrel 88 of plugging tool 76 with the plug magazine 86 and of the plug 78 with the defective tube 38 as the guide fixture support structure 144 is moved toward same when the guidance mechanism 84 is disposed at the respective plug dispensing and applying positions of FIG. 2. On the one hand, FIG. 6 schematically illustrates the plugging tool 76 in solid line form laterally misaligned with a tube sheet hole 30 and in dashed line form after alignment with and insertion within the hole 30 due to coaction of the compliance elements 156 of the guidance mechanism 84. When the plug 78 is inserted, lateral forces caused by interference produce translational reaction or motion through the elements 156 which thus relieve the interference. On the other hand, FIG. 7 schematically illustrates the plugging tool 76 in solid line form angularly misaligned with the tube sheet hole 30 and in dashed line form after alignment with and insertion within the hole 30 due to coaction of the compliance elements 156. In this case when the plug 78 is inserted, the angular interference causes a moment on the plug whereupon a rotational reaction or moment by the elements 156 will relieve this interference also. This combination of reaction capabilities minimizes insertion forces and jamming during plug installation.

The compliance elements 156 also are oriented relative to one another and coact together to define a center of compliance P oriented with respect to a central axis C of the plugging tool 76 so as to project to a point on the central axis C of the plugging tool 76 located at the leading end 158 of the mandrel 88. In such orientation, even though the compliance elements 156 are located at the trailing or rear side of the tool 76, the tool will react as if it were being pulled at its leading end 158 when its mandrel 88 is inserted either into the plug magazine or the defective tube 38. For a detailed discussion of compliance systems using elastomer technology, attention is directed to an article entitled "Compliance for Robotic Assembly using Elastomeric Technology" by Jack Rebman, presented at the 9th. International Symposium on Industrial Robots, March 1979, Washington, D. C.

As mentioned earlier, the p tool 76 can be the one disclosed in U.S. Pat. No. 4,369,662. As depicted in FIGS. 3 to 5 herein, the tool 76 has a hydraulic cylinder 160 and distance transducers (not shown) to monitor the motion of the tool mandrel 88 during plug expansion in the defective tube 38. Also, the tool 76 carries a bracket 162 for a CCTV camera 164 and a high intensity halogen lamp 166. The camera 164 is used to remotely verify the operation of loading a plug 78 from the plug magazine 86 and subsequently unloading or installing it in a selected tube 38.

Plug Magazine

Figure 9:
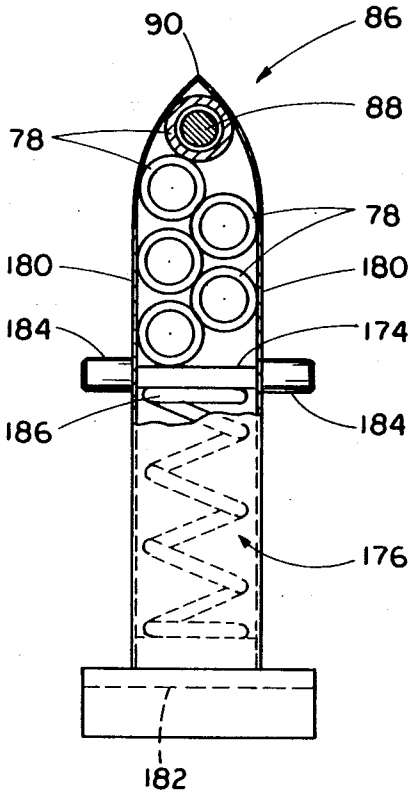
FIG. 9 is an end elevational view of the plug magazine as seen along line 9—9 of FIG. 8 with the upper half of its end wall broken away to expose the staggered stack of plugs contained therein.
Figure 8:
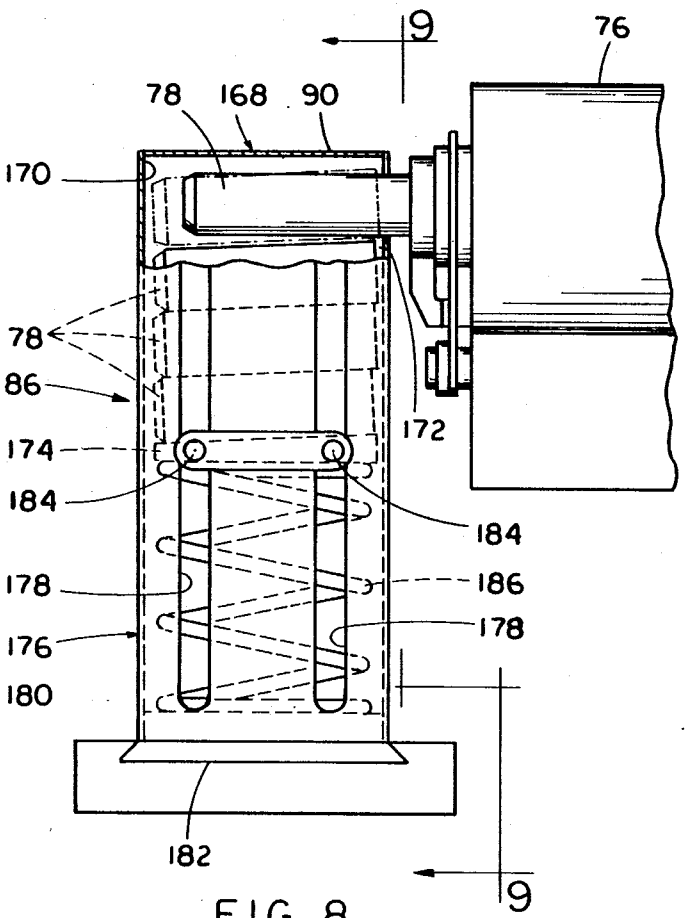
FIG. 8 is an enlarged fragmentary view of the end effector apparatus of FIG. 3, showing the plug magazine of the apparatus with its upper portion broken away to expose the mandrel of the plugging tool being inserted within the uppermost plug of the stack thereof contained in the magazine.

Finally, as seen in FIGS. 3 to 5 and in greater detail in FIGS. 8 and 9, the plug magazine 86 of the effector apparatus 50 includes a housing 168 disposed on the base 80 and defining a chamber 170 containing the plugs 78. At its upper end 90, the housing also defines an opening 172 through which plugs 78 are dispensed one at a time from the chamber. Within the housing 168 is provided a support in the form of a platform 174 for holding a plurality of plugs 78 in the chamber 170. Also, the plug magazine 86 includes means, generally designated 176, for linearly guiding and angularly biasing the support platform 174 for movement toward the upper dispensing opening 172 of the housing 168 for ensuring that a plug 78 is always disposed at the opening 172.

Since the housing 168 has a width less than the width of a pair of the plugs 78, the plugs are maintained in a staggered stacked relationship in the chamber 170 upon the plug support platform 174, thus increasing the capacity of the magazine. Also, since the upper end 90 of the housing 168 progressively narrows to a width less than that of a single plug, a self-centering action occurs which brings the uppermost one of the plugs 78 into alignment with the upper dispensing opening 172 as the plugs are moved upwardly toward the upper housing end 90.

The guiding and biasing means 176 of the plug magazine includes a pair of spaced guide slots 178 defined in opposite lateral walls 180 of the housing 168 and extending between the upper end 90 and the lower end 182 thereof. Also, means 176 includes a pair of guide posts 184 connected to the plug support platform 174 and extending through the guide slots 178 and a compression spring 186 disposed between the lower housing end 182 and the plug support platform 174. The spring 186 biases the support platform 174 in an upward direction for feeding plugs 78 toward the dispensing opening 172 defined at the upper end 90 of the housing 168. Also, the platform 174 is at an inclined attitude, such as at a three-degree angle to the horizontal, so that any intermeshing between the lands of adjacent plugs 78 will be held to a minimum so as not to interfere with loading of the upper most plug onto the tool mandrel 88. Specifically, as seen in FIG. 8, when the tool mandrel 88 is inserted into the uppermost plug 78, it raises the plug to a horizontal position in which it is substantially free of the next lower plug. Now any frictional forces between the upper two plugs 78 can be easily overcome when the upper plug is withdrawn from magazine 86.

It is thought that the present invention and many of its attendant advantages will be understood from the foregoing description and it will be apparent that various changes may be made in the form, construction and arrangement of the parts described herein without departing from the spirit and scope of the invention or sacrificing all of its material advantages, the form hereinbefore described being merely a preferred or exemplary embodiment thereof.

We claim:

1. An apparatus for moving and positioning a tool for obtaining and using secondary workpieces to perform operations on a primary workpiece, said apparatus comprising:

(a) a base;

(b) a guidance mechanism having said tool smounted thereon and being operable to align and position said tool for effecting an operation by said tool wherein one of said secondary workpieces is applied on said primary workpiece and for effecting loading of another of said secondary workpieces on said tool after each operation thereof;

(c) a positioning mechanism movably supported on said base and having said guidance mechanism mounted thereon, said positioning mechanism being operable to move said guidance mechanism and said tool therewith between respective tool operating and secondary workpiece loading positions and (d) a magazine supported on said base and containing a plurality of said secondary workpieces for loading on said tool when said tool is moved with said guidance mechanism to said loading position by said positioning mechanism.

2. An apparatus for moving and positioning a tool for plugging a defective heat exchanger tube of a steam generator in a nuclear reactor, said apparatus comprising:

(a) a plug magazine;

(b) a guidance mechanism mounting said plugging tool and being operable to align and position said tool relative to said plug magazine and said defective heat exchanger tube to correspondingly effect, upon operation of said tool, plug loading when said tool is located in a plug dispensing position adjacent to said plug magazine and plug unloading when said tool is located in a plug applying position adjacent to said defective tube; and (c) a positioning mechanism mounting said guidance mechanism, said positioning mechanism being operable to transfer said guidance mechanism and said plugging tool therewith between said plug dispensing and applying positions located respectively adjacent to said plug magazine and said defective heat exchanger tube.

3. The apparatus as recited in claim 2, wherein said positioning mechanism is operable to assume a folded condition when said plugging tool is located in said plug dispensing position and an unfolded condition when said plugging tool is located in said plug applying position.

4. The apparatus as recited in claim 2, further comprising:

(d) a base supporting said plug magazine and said positioning mechanism.

5. The apparatus as recited in claim 4, wherein said positioning mechanism includes:

an articulated linkage being pivotally coupled to said base by a first pair of pivotal connections and pivotally coupled to said guidance mechanism by a second pair of pivotal connections; and power means coupled to said articulated linkage for actuating said linkage between folded and unfolded conditions for respectively moving said plugging tool between said plug dispensing and applying positions.

6. The apparatus as recited in claim 5, wherein one of said pivotal connections of said first pair thereof is disposed stationary with respect to said base, whereas the other of said pivotal connections is movable with respect to said base away from and toward said one stationary pivotal connection, as said linkage is actuated between said respective folded and unfolded positions.

7. The apparatus as recited in claim 5, wherein one of said pivotal connections of said second pair thereof revolves about the other of said pivotal connections of said second pair while concurrently said other pivotal connection of said second pair moves toward and away from said other pivotal connection of said first pair as said linkage is actuated between said respective folded and unfolded positions.

8. The apparatus as recited in claim 5, wherein said articulated linkage includes a pair of elongated links disposed along each lateral side of said base and pivotally interconnected to one another in sissor-like fashion, one of said links being pivotally coupled at a lower end thereof to said base so as to form a pivotal connection which is disposed stationary with respect to said base and the other of said links being pivotally coupled at a lower end thereof to an elongated slot defined in said base so as to form a pivotal connection which is movable with respect to said base away from and toward said stationary pivotal connection of said one link to said base.

9. The apparatus as recited in claim 8, wherein said articulated linkage includes a third elongated link disposed along each lateral side of said base, said one of said pair of links being pivotally coupled at an upper end thereof to a lower end of said third link, said third link in turn being pivotally coupled at an upper end to said guidance mechanism and said other of said pair of links being pivotally coupled at an upper end to said guidance mechanism such that upon movement of said articulated linkage between its folded and unfolded conditions said guidance mechanism is rotated between angularly displaced plug dispensing and plug applying positions.

10. The apparatus as recited in claim 9, wherein said power means includes an extendible and retractible member disposed along each lateral side of said base, said member being anchored at one end to said base and pivotally coupled at an opposite end to both said upper end of said one of said pair of links and said lower end of said third link.

11. The apparatus as recited in claim 2, wherein said guidance mechanism includes:

a guide fixture mounted on said positioning mechanism for movement toward and away from said plug magazine and said defective heat exchanger tube when said guidance mechanism and said plugging tool are disposed respectively at said plug dispensing and applying positions;

a remote center compliance device extending between said plugging tool and said guide fixture so as to interconnect said tool to said guide fixture, said compliance device being operable to correct lateral and angular misalignments of said tool with said plug magazine and said defective tube as said guide fixture is moved toward the same when said guidance mechanism is disposed at said respective plug dispensing and applying positions; and drive means for moving said guide fixture toward and away from said plug magazine and said defective tube when said guidance mechanism is disposed at said respective plug dispensing and applying positions.

12. The apparatus as recited in claim 11, wherein said compliance device of said guidance mechanism defines a center of compliance and is oriented with respect to a central axis of said plugging tool so as to project its center of compliance to a point on said central axis of said plugging tool located at a leading end of said tool.

13. The apparatus as recited in claim 11, wherein said compliance device of said guidance mechanism exhibits high lateral flexibility and high axial inflexibility such that it corrects lateral and angular misalignments of said tool with said plug magazine and said defective tube as said guide fixture is moved toward same when said guidance mechanism is disposed at said respective plug dispensing and applying positions.

14. The apparatus as recited in claim 13, wherein said compliance device of said guidance mechanism includes a plurality of laminated elastomer and metal shim elements.

15. The apparatus as recited in claim 11, wherein said compliance device of said guidance mechanism defines a center of compliance and is oriented with respect to a central axis of said plugging tool so as to project its center of compliance to a point on said central axis of said plugging tool located at a leading end of said tool, said compliance device exhibiting high lateral flexibility and high axial inflexibility such that it corrects lateral and angular misalignments of said leading tool end with said plug magazine and said defective tube as said guide fixture is moved toward the same when said guidance mechanism is disposed at said respective plug dispensing and applying positions.

16. The apparatus as recited in claim 15, wherein said compliance device of said guidance mechanism includes a plurality of laminated elastomer and metal shim elements.

17. The apparatus as recited in claim 11, wherein said guide fixture of said guidance mechanism includes:

a guide block mounted on said positioning mechanism; and a support structure mounted on said guide block and movable along a generally translatory path toward and away from said plug magazine and said defective tube when said guidance mechanism is disposed at said respective plug dispensing and applying positions, said support structure being connected to said compliance device.

18. The apparatus as recited in claim 2, wherein said plug magazine includes:

a housing defining a chamber for containing plugs and an opening for dispensing said plugs from said chamber;

a support for holding a plurality of said plugs in said chamber; and means guiding and biasing said support for movement toward said dispensing opening of said housing for disposing a plug at said opening.

19. The apparatus as recited in claim 18, wherein said guiding and biasing means of said plug magazine includes:

means defining a plurality of guide slots in said housing extending between upper and lower ends thereof;

guide posts connected to said plug support and extending through said guide slots; and a compression spring disposed between said lower housing end and said plug support for biasing said support in an upward direction for feeding plugs toward said dispensing opening being defined at said upper end of said housing.

20. The apparatus as recited in claim 19, wherein said housing has a width less than the width of a pair of said plugs such that said plugs are maintained in a staggered stacked relationship in said chamber and upon said plug support, said upper end of said housing progressively narrowing to a width less than that of one of said plugs for causing self-centering of a plug into alignment with said dispensing opening defined at said upper end of said housing as said plugs are moved upwardly toward said upper housing end.

21. An apparatus for moving and positioning a tool for plugging a defective heat exchanger tube of a steam generator in a nuclear reactor, said apparatus comprising:

(a) a base;

(b) a plug magazine supported on said base;

(c) a guidance mechanism mounting said plugging tool and being operable to align and position said tool relative to said plug magazine and said defective heat exchanger tube to correspondingly effect, upon operation of said tool, plug loading when said tool is located in a plug dispensing position adjacent, to said plug magazine and plug unloading when said tool is located in a plug applying position adjacent to said defective tube, said guidance mechanism including (i) a guide fixture movable toward and away from said plug magazine and said defective heat exchanger tube when said guidance mechanism and said plugging tool are disposed respectively at said plug dispensing and applying positions, (ii) a remote center compliance device extending between said plugging tool and said guide fixture so as to interconnect said tool to said guide fixture, said compliance device being operable to correct lateral and angular misalignments of said tool with said plug magazine and said defective tube as said guide fixture is moved toward same when said guidance mechanism is disposed at said respective plug dispensing and applying positions, and (iii) drive means for moving said guide fixture toward and away from said plug magazine and said defective tube when said guidance mechanism is disposed at said respective plug dispensing and applying positions; and (d) a positioning mechanism supported on said base and mounting said guide fixture of said guidance mechanism, said positioning mechanism being operable to transfer said guidance mechanism and said plugging tool therewith between said plug dispensing and applying positions located respectively adjacent to said plug magazine and said defective heat exchanger tube, said positioning mechanism being operable to assume a folded condition when said plugging tool is located in said plug dispensing position and an unfolded condition when said plugging tool is located in said plug applying position, said positioning mechanism including (i) an articulated linkage being pivotally coupled to said base by a first pair of pivotal connections and pivotally coupled to said guide fixture of said guidance mechanism by a second pair of pivotal connections, and (ii) power means coupled to said articulated linkage for actuating said linkage between said folded and unfolded conditions for respectively moving said plugging tool between said plug dispensing and applying positions.

22. The apparatus as recited in claim 21, wherein said articulated linkage includes a pair of elongated links disposed along each lateral side of said base and pivotally interconnected to one another in sissor-like fashion, one of said links being pivotally coupled at a lower end thereof to said base so as to form a pivotal connection which is disposed stationary with respect to said base and the other of said links being pivotally coupled at a lower end thereof to an elongated slot defined in said base so as to form a pivotal connection which is movabale with respect to said base away from and toward said stationary pivotal connection of said one link to said base.

23. The apparatus as recited in claim 22, wherein said articulated linkage includes a third elongated link disposed along each lateral side of said base, said one of said pair of links being pivotally coupled at an upper end thereof to a lower end of said third link, said third link in turn being pivotally coupled at an upper end to said guide fixture of said guidance mechanism and said other of said pair of links being pivotally coupled at an upper end to said guide fixture of said guidance mechanism such that upon movement of said articulated linkage between its folded and unfolded conditions said guidance mechanism is rotated between angularly displaced plug dispensing and plug applying positions.

24. The apparatus as recited in claim 23, wherein said power means includes an extendible and retractible member disposed along each lateral side of said base, said member being anchored at one end to said base and pivotally coupled at an opposite end to both said upper end of said one of said pair of links and said lower end of said third link.

25. The apparatus as recited in claim 21, wherein said compliance device of said guidance mechanism includes a plurality of laminated elastomer and metal shim elements.

26. The apparatus as recited in claim 21, wherein said guide fixture of said guidance mechanism includes:

a guide block mounted on said articulated linkage of said positioning mechanism; and a support structure mounted on said guide block and movable along a generally translatory path toward and away from said plug magazine and said defective tube when said guidance mechanism is disposed at said respective plug dispensing and applying positions, said support structure being connected to said compliance device.

27. The apparatus as recited in claim 21, wherein said plug magazine includes:

a housing disposed on said base and defining a chamber for containing plugs and an opening for dispensing said plugs from said chamber;

a support for holding a plurality of said plugs in said chamber; and means guiding and biasing said support for movement toward said dispensing opening of said housing for disposing a plug at said opening.

28. The apparatus as recited in claim 27, wherein said guiding and biasing means of said plug magazine includes:

means defining a plurality of guide slots in said housing extending between upper and lower ends thereof;

guide posts connected to said plug support and extending through said guide slots; and a compression spring disposed between said lower housing end and said plug support for biasing said support in an upward direction for feeding plugs toward said dispensing opening defined at said upper end of said housing.

29. The apparatus as recited in claim 28, wherein said housing has a width less than the width of a pair of said plugs such that said plugs are maintained in a staggered stacked relationship in said chamber and upon said plug support, said upper end of said housing progressively narrowing to a width less than that of one of said plugs for causing self-centering of a plug into alignment with said dispensing opening defined at said upper end of said housing as said plugs are moved upwardly toward said upper housing end.

* * * * *